US009090435B2

(12) United States Patent
Kawakami et al.

(10) Patent No.: US 9,090,435 B2
(45) Date of Patent: Jul. 28, 2015

(54) ELEVATOR HOISTING MACHINE AND ELEVATOR HOISTING MACHINE MANUFACTURING METHOD

(75) Inventors: Shigenobu Kawakami, Tokyo (JP); Hiroshi Narasada, Tokyo (JP); Seiji Okuda, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 594 days.

(21) Appl. No.: 13/522,437

(22) PCT Filed: Feb. 8, 2010

(86) PCT No.: PCT/JP2010/051778

§ 371 (c)(1),
(2), (4) Date: Jul. 16, 2012

(87) PCT Pub. No.: WO2011/096079

PCT Pub. Date: Aug. 11, 2011

(65) Prior Publication Data

US 2012/0292135 A1 Nov. 22, 2012

(51) Int. Cl.
*B66B 1/34* (2006.01)
*B66B 11/04* (2006.01)

(52) U.S. Cl.
CPC ..... *B66B 11/043* (2013.01); *Y10T 29/49826* (2015.01)

(58) Field of Classification Search
CPC ..... B66B 5/04; B66B 5/06; B66B 11/043; Y10T 29/49826
USPC ..... 187/247, 391, 393, 414; 324/160, 163, 324/164, 173, 207.2, 207.24
See application file for complete search history.

(56) References Cited

U.S. PATENT DOCUMENTS 4,355,785 A * 10/1982 Tosato et al. ..... 254/362
4,365,964 A * 12/1982 Krome, Jr. ..... 474/28
5,002,157 A * 3/1991 Heikkinen ..... 187/254

(Continued)

FOREIGN PATENT DOCUMENTS

JP 2005 337716 12/2005
JP 2006 112965 4/2006

(Continued)

OTHER PUBLICATIONS

International Search Report Issued May 18, 2010 in PCT/JP10/51778 Filed Feb. 8, 2010.

*Primary Examiner* — Anthony Salata
(74) *Attorney, Agent, or Firm* — Oblon, McClelland, Maier & Neustadt, L.L.P.

(57) ABSTRACT

A coupling shaft includes: a boss portion; and a rotation detector mounting shaft portion that protrudes outward from the boss portion away from the motor shaft. An inner circumferential surface of a penetrating aperture disposed on a mounting member is an inclined pressing surface that is inclined relative to a shaft axis of the motor shaft such that an inside diameter of the penetrating aperture increases continuously toward the motor shaft. An inclined bearing surface that is inclined relative to a shaft axis of the coupling shaft is disposed on the boss portion so as to be formed into an annular shape around the shaft axis of the coupling shaft, and such that an outside diameter of the boss portion increases continuously toward the motor shaft. The inclined pressing surface is able to contact the inclined bearing surface by the mounting member being displaced toward the motor shaft.

9 Claims, 5 Drawing Sheets

(56) References Cited

U.S. PATENT DOCUMENTS

| | | | | |
|---|---|---|---|---|
| 5,223,679 | A * | 6/1993 | Yoo | 187/394 |
| 5,433,294 | A * | 7/1995 | Walker | 187/254 |
| 6,398,521 | B1 * | 6/2002 | Yorulmazoglu | 417/360 |
| 7,243,759 | B2 * | 7/2007 | Doran | 187/277 |
| 7,500,543 | B2 * | 3/2009 | Doran | 187/277 |
| 7,728,583 | B2 * | 6/2010 | Waters et al. | 324/207.25 |
| 8,471,194 | B2 * | 6/2013 | Dolenti et al. | 250/231.13 |
| 2003/0121731 | A1 * | 7/2003 | Santos et al. | 187/391 |
| 2006/0254864 | A1 * | 11/2006 | Grigo et al. | 187/393 |
| 2007/0108967 | A1 | 5/2007 | Okuya et al. | |

FOREIGN PATENT DOCUMENTS

| | | |
|---|---|---|
| JP | 2006 176325 | 7/2006 |
| JP | 2007 139458 | 6/2007 |
| JP | 2007 161416 | 6/2007 |

* cited by examiner

ELEVATOR HOISTING MACHINE AND ELEVATOR HOISTING MACHINE MANUFACTURING METHOD

TECHNICAL FIELD

The present invention relates to an elevator hoisting machine that generates a driving force that moves a car, and to an elevator hoisting machine manufacturing method.

BACKGROUND ART

Conventionally, in order to detect a rotational position of a motor shaft, constructions for mounting a rotary encoder have been proposed in which a coupling shaft is mounted to an end portion of the motor shaft, and a rotary encoder is mounted to this coupling shaft. An interfitting aperture into which the end portion of the motor shaft is inserted is disposed on the coupling shaft. The coupling shaft is mounted to the motor shaft by the end portion of the motor shaft being inserted into the interfitting aperture of the coupling shaft. A screw-threaded aperture that passes through an insertion aperture from outside the coupling shaft is disposed on the coupling shaft. The coupling shaft is fixed to the motor shaft by a set screw that is screwed into the screw-threaded aperture (See Patent Literature 1).

CITATION LIST

Patent Literature

[Patent Literature 1]
Japanese Patent Laid-Open No. 2006-112965 (Gazette)

SUMMARY OF THE INVENTION

Problem to be Solved by the Invention

Conventionally, in order to improve elevator driving control systems, an encoder may be mounted to an existing hoisting machine during elevator modification work. In such cases, in conventional rotary encoder mounting constructions, if a length of a portion of the motor shaft that protrudes outward from the hoisting machine is very short, the end portion of the motor shaft cannot be inserted into the interfitting aperture of the coupling shaft, making it impossible to mount the coupling shaft to the motor shaft. Thus, it is impossible to make the existing hoisting machine into a hoisting machine with an encoder.

It is also conceivable for a coupling shaft to be fixed to an end portion of the motor shaft simply using a bolt, but an adjusting operation in which a shaft axis of the motor shaft is aligned with a shaft axis of the coupling shaft (a centering operation) is time-consuming, making converting an existing hoisting machine to a hoisting machine with an encoder time-consuming.

The present invention aims to solve the above problems and an object of the present invention is to provide an elevator hoisting machine and an elevator hoisting machine manufacturing method in which manufacturing can be performed more reliably and easily.

Means for Solving the Problem

In order to achieve the above object, according to one aspect of the present invention, there is provided an elevator hoisting machine including: a motor including: a motor main body; and a motor shaft that is rotated by the motor main body; a coupling shaft including: a boss portion; and a rotation detector mounting shaft portion that protrudes outward from the boss portion away from the motor shaft, the coupling shaft being mountable to and removable from an end portion of the motor shaft; a mounting member on which is disposed a penetrating aperture through which the rotation detector mounting shaft portion is passed; and a rotation detector that is mounted to the rotation detector mounting shaft portion, the elevator hoisting machine being characterized in that: an inner circumferential surface of the penetrating aperture is an inclined pressing surface that is inclined relative to a shaft axis of the motor shaft such that an inside diameter of the penetrating aperture increases continuously toward the motor shaft; an inclined bearing surface that is inclined relative to a shaft axis of the coupling shaft is disposed on the boss portion so as to be formed into an annular shape around the shaft axis of the coupling shaft, and such that an outside diameter of the boss portion increases continuously toward the motor shaft; and the inclined pressing surface is able to contact the inclined bearing surface by the mounting member being displaced toward the motor shaft.

According to another aspect of the present invention, there is provided an elevator hoisting machine manufacturing method characterized in including: a shaft temporary fastening step in which a coupling shaft that has: a boss portion; and a rotation detector mounting shaft portion that protrudes outward from the boss portion away from a motor shaft, is mounted to an end portion of the motor shaft such that displacement of the coupling shaft is permitted in a direction that is perpendicular to a shaft axis of the motor shaft; a mounting member disposing step in which a mounting member on which is disposed a penetrating aperture that has a center line and that has an inner circumferential surface that is an inclined pressing surface that is inclined relative to the center line is disposed in a state in which the rotation detector mounting shaft portion passes through the penetrating aperture; a position adjusting step in which a position of the coupling shaft is adjusted so as to be coaxial to the motor shaft by pressing the mounting member toward the motor shaft while keeping the inclined pressing surface in contact with an annular inclined bearing surface that is disposed on the boss portion as the motor shaft and the coupling shaft are rotated; a shaft fixing step in which the coupling shaft is fixed to the motor shaft after the position adjusting step; and a rotation detector mounting step in which a rotation detector is mounted to the rotation detector mounting shaft portion after the shaft fixing step.

Effects of the Invention

In an elevator hoisting machine of this kind, because the penetrating aperture that has as an inner circumferential surface the inclined pressing surface that is inclined relative to the shaft axis of the motor shaft is disposed on the mounting member, and the annular inclined bearing surface that is inclined relative to the shaft axis of the coupling shaft is disposed on the boss portion of the coupling shaft, and the inclined pressing surface is able to contact the inclined bearing surface by the mounting member being displaced toward the motor shaft, the position of the coupling shaft that is mounted to the end portion of the motor shaft can be adjusted to a position that is coaxial to the motor shaft by rotating the motor shaft and the coupling shaft while keeping the inclined pressing surface in contact with the inclined bearing surface. Consequently, an adjusting operation (a centering operation) to align the shaft axis of the coupling shaft to the shaft axis of the motor shaft can be performed easily. Because it is no longer necessary to make a construction in which the end portion of the motor shaft fits into an interfitting aperture on the coupling shaft, the coupling shaft can be mounted to the end portion of the motor shaft even if the protruding portion of the motor shaft is extremely short. Thus, manufacturing of the hoisting machine can be performed more reliably and easily.

In a method for manufacturing an elevator hoisting machine of this kind, because the coupling shaft is fastened temporarily to the end portion of the motor shaft, and then the position of the coupling shaft is adjusted so as to be coaxial to the motor shaft by pressing the mounting member while keeping the inclined pressing surface in contact with the inclined bearing surface as the motor shaft and the coupling shaft are rotated, the centering operation can be performed easily. Because the position of the coupling shaft is adjusted in a state in which the coupling shaft is fastened temporarily to the motor shaft, it is no longer necessary to make a construction in which the end portion of the motor shaft fits into an interfitting aperture on the coupling shaft, enabling the coupling shaft to be mounted to the end portion of the motor shaft even if the protruding portion of the motor shaft is extremely short. Thus, manufacturing of the hoisting machine can be performed more reliably and easily.

DESCRIPTION OF EMBODIMENTS

A preferred embodiment of the present invention will now be explained with reference to the drawings.

Embodiment 1

Figure 1:
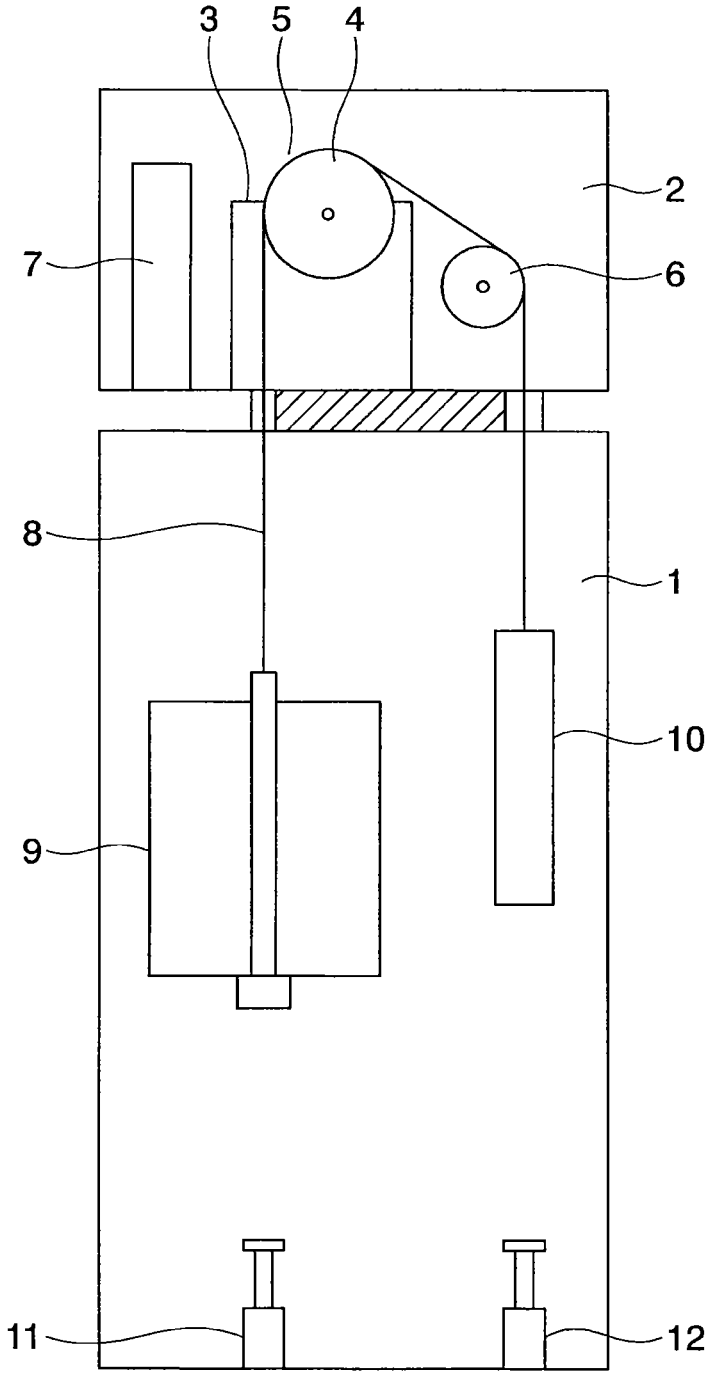
FIG. 1 is a configuration diagram that shows an elevator according to Embodiment 1 of the present invention.

FIG. 1 is a configuration diagram that shows an elevator according to Embodiment 1 of the present invention. In the figure, a machine room 2 is disposed in an upper portion of a hoistway 1. Disposed inside the machine room 2 are: a hoisting machine (a driving machine) 5 that has: a hoisting machine main body 3; and a driving sheave 4 that is rotated by the hoisting machine main body 3; a deflecting sheave 6 that is disposed so as to be separated from the driving sheave 4; and a controlling apparatus 7 that controls elevator operation.

A main rope 8 is wound around the driving sheave 4 and the deflecting sheave 6. A car 9 and a counterweight 10 that can be raised and lowered inside the hoistway 1 are suspended by the main rope 8. The car 9 and the counterweight 10 are raised and lowered inside the hoistway 1 by rotation of the driving sheave 4.

Moreover, a car buffer 11 that is positioned below the car 9, and a counterweight buffer 12 that is positioned below the counterweight 10 are disposed in a bottom portion (a pit) of the hoistway 1. If subjected to a collision with the car 9, the car buffer 11 relieves mechanical shock that is imparted to the car 9. If subjected to a collision with the counterweight 10, the counterweight buffer 12 relieves mechanical shock that is imparted to the counterweight 10.

Figure 2:
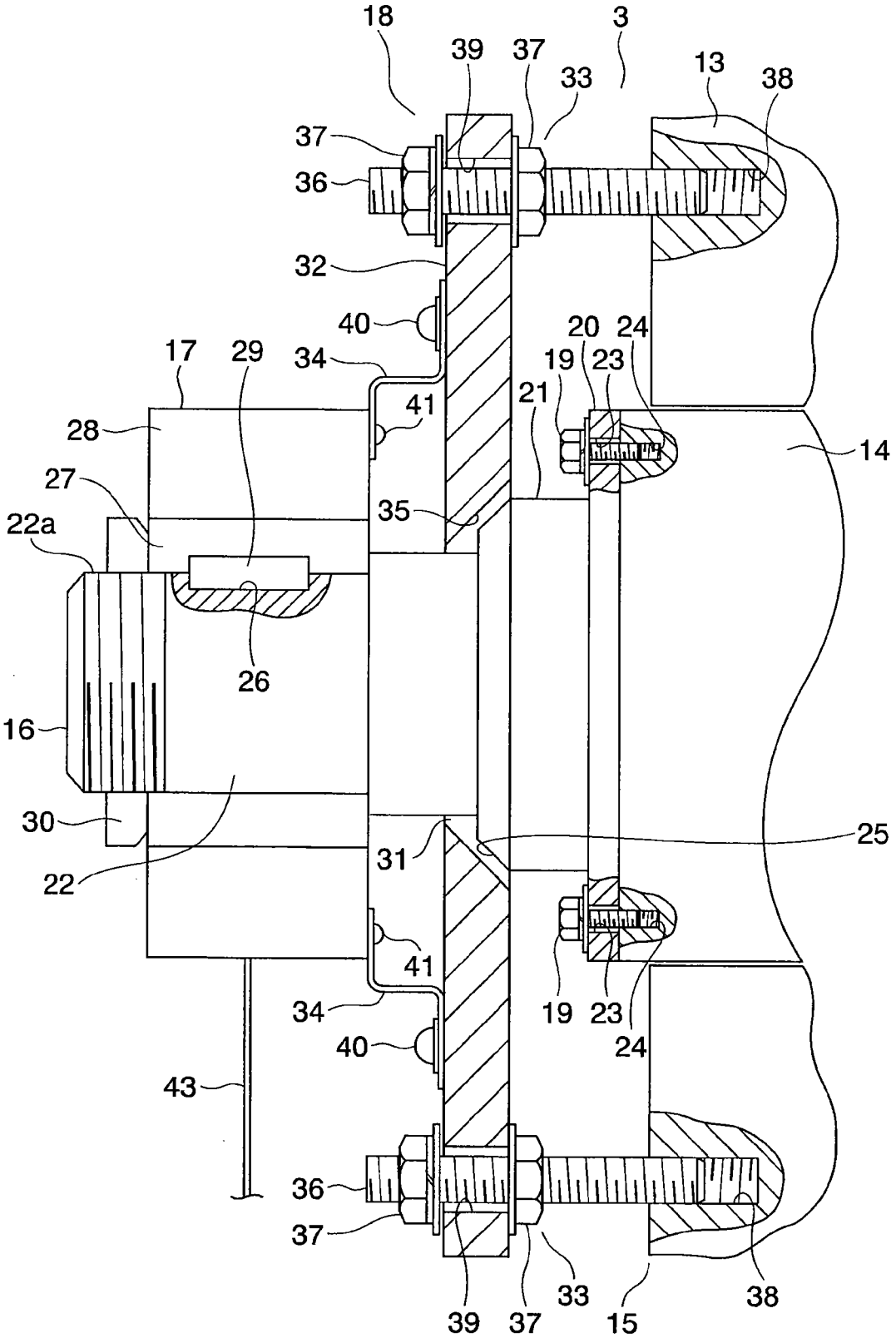
FIG. 2 is a partial cross section that shows a hoisting machine main body from FIG. 1.

FIG. 2 is a partial cross section that shows the hoisting machine main body 3 from FIG. 1. In the figure, the hoisting machine main body 3 has: a motor 15 that has: a motor main body 13; and a motor shaft 14 that is rotated by the motor main body 13; a coupling shaft 16 that is mounted to the motor shaft 14; an encoder (a rotation detector) 17 that is mounted to the coupling shaft 16; and a holding apparatus 18 that holds the encoder 17. Specifically, the hoisting machine 5 is a hoisting machine with an encoder in which an encoder 17 is mounted to an existing hoisting machine by means of a coupling shaft 16.

The driving sheave 4 (FIG. 1) is fixed to a front end portion (a first end portion) of the motor shaft 14. Thus, the driving sheave 4 is rotated around the shaft axis of the motor shaft 14 together with the motor shaft 14.

The coupling shaft 16 is fixed to a back end portion (a second end portion) of the motor shaft 14 by a pair of bolts 19. Consequently, the coupling shaft 16 is mountable to and removable from the end portion of the motor shaft 14. The coupling shaft 16 is fixed to the motor shaft 14 in a state in which a shaft axis of the coupling shaft 16 is aligned with the shaft axis of the motor shaft 14. In addition, the coupling shaft 16 has: a tabular coupling shaft mount portion 20 that is placed in contact with an end surface of the back end portion of the motor shaft 14; a boss portion 21 that is disposed on the coupling shaft mount portion 20; and a rotation detector mounting shaft portion 22 that protrudes outward from the boss portion 21 away from the motor shaft 14. The coupling shaft mount portion 20, the boss portion 21, and the rotation detector mounting shaft portion 22 are disposed so as to be coaxial to the shaft axis of the coupling shaft 16.

Figure 3:
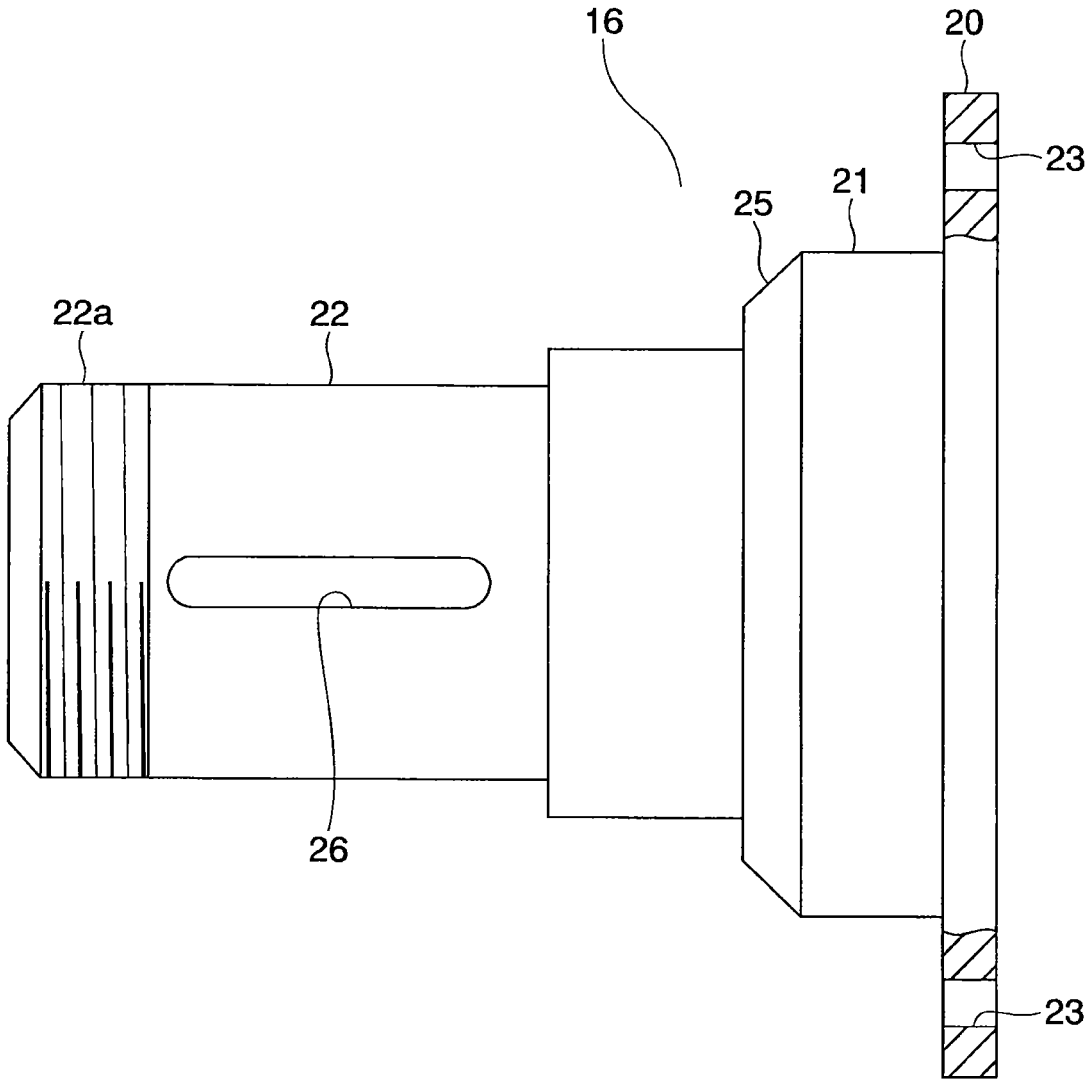
FIG. 3 is a partial cross section that shows a coupling shaft from FIG. 2.

Now, FIG. 3 is a partial cross section that shows the coupling shaft 16 from FIG. 2. A pair of bolt passage apertures 23 through which bolts 19 are passed are disposed on the coupling shaft mount portion 20. Respective positions of the bolt passage apertures 23 are symmetrical in relation to the shaft axis of the coupling shaft 16.

A pair of screw-threaded apertures 24 into which the bolts 19 are screwed are disposed on the end surface of the back end portion of the motor shaft 14 so as to be aligned with the positions of the bolt passage apertures 23, as shown in FIG. 2. Consequently, the respective positions of the screw-threaded apertures 24 are symmetrical in relation to the shaft axis of the motor shaft 14. Each of the screw-threaded apertures 24 is disposed on the back end portion of the motor shaft 14 so as to have a depth direction that is parallel to the shaft axis of the motor shaft 14. The coupling shaft 16 is fixed to the motor shaft 14 by the bolts 19 being passed through the bolt passage apertures 23, screwed into the respective screw-threaded apertures 24, and fastened.

An inside diameter of the bolt passage apertures 23 is greater than an outside diameter of screw-threaded portions of the bolts 19. Consequently, when the bolts 19 are screwed loosely into the respective screw-threaded apertures 24, displacement of the coupling shaft 16 in a direction that is perpendicular to the shaft axis of the motor shaft 14 is permitted within a range of the inside diameter of the bolt passage apertures 23.

The boss portion 21 is disposed on an opposite side of the coupling shaft mount portion 20 from the motor shaft 14. An outside diameter of the boss portion 21 is smaller than an outside diameter of the coupling shaft mount portion 20. An inclined bearing surface 25 that is formed into an annular shape that is centered around the shaft axis of the coupling shaft 16 is disposed on a portion of the boss portion 21 near the rotation detector mounting shaft portion 22. The inclined bearing surface 25 is an annular inclined surface that is inclined relative to the shaft axis of the coupling shaft 16 such that the outside diameter of the boss portion 21 increases continuously toward the motor shaft 14. In this example, a width dimension of the inclined bearing surface 25 (a dimension of the inclined bearing surface 25 that is parallel to a direction of inclination of the inclined bearing surface 25) is 2 mm.

An outside diameter of the rotation detector mounting shaft portion 22 is smaller than the outside diameter of the boss portion 21. A screw-threaded portion 22*a* is disposed on a tip end portion of the rotation detector mounting shaft portion 22 (an end portion on a side away from the boss portion 21). A keyway 26 that is parallel to the shaft axis of the coupling shaft 16 is disposed on an intermediate portion of the rotation detector mounting shaft portion 22.

As shown in FIG. 2, the encoder 17 has: a rotating portion 27 that is rotated together with the rotation detector mounting shaft portion 22; and an annular fixed portion 28 that surrounds the rotating portion 27. The fixed portion 28 generates a signal that corresponds to the rotation of the rotating portion 27. The signal from the fixed portion 28 is sent to the controlling apparatus 7 (FIG. 1) through a signal wire 43. The controlling apparatus 7 controls elevator operation based on the signal from the encoder 17.

A key 29 that prevents positional drift of the rotating portion 27 relative to the rotation detector mounting shaft portion 22 is inserted into the keyway 26. The fixed portion 28 is held by the holding apparatus 18. Consequently, rotation of the fixed portion 28 relative to the motor main body 13 is suppressed by the holding apparatus 18. A bearing nut 30 that prevents the encoder 17 from dislodging from the rotation detector mounting shaft portion 22 is screwed onto the screw-threaded portion 22*a*.

The holding apparatus 18 has: a mounting plate (a mounting member) 32 on which is disposed a penetrating aperture 31 through which the rotation detector mounting shaft portion 22 is passed; a supporting apparatus 33 that is disposed on the motor main body 13, and that supports the mounting plate 32; and a pair of leaf springs (connecting members) 34 that are disposed on the mounting plate 32, and that constitute an elastic body that is connected to the fixed portion 28.

The mounting plate 32 is supported by the supporting apparatus 33 in a state in which the rotation detector mounting shaft portion 22 is passed through the penetrating aperture 31. The mounting plate 32 is fixed to the motor main body 13 by the supporting apparatus 33 such that a center line of the penetrating aperture 31 is aligned with the shaft axis of the motor shaft 14. The mounting plate 32 is supported by the supporting apparatus 33 so as to be separated from the coupling shaft 16.

Figure 4:
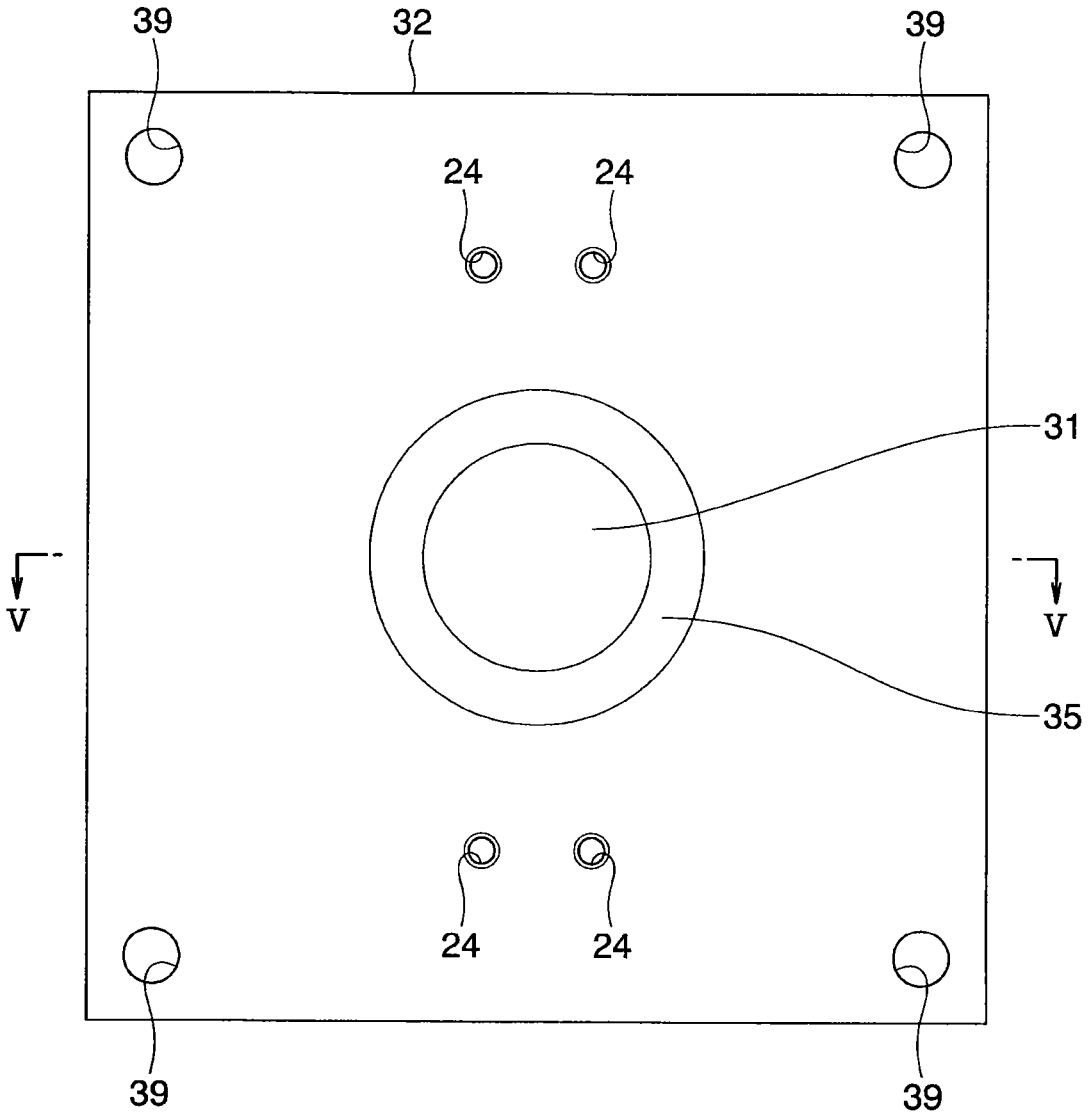
FIG. 4 is a front elevation that shows a mounting plate from FIG. 2.
Figure 5:
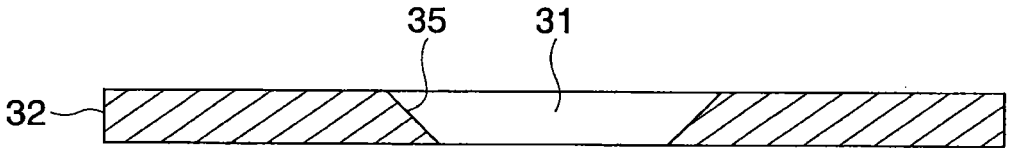
FIG. 5 is a cross section that is taken along line V-V in FIG. 4.

Now, FIG. 4 is a front elevation that shows the mounting plate 32 from FIG. 2. FIG. 5 is a cross section that is taken along line V-V in FIG. 4. An external shape of the mounting plate 32 is square, and a cross-sectional shape of the penetrating aperture 31 is circular. An inner circumferential surface of the penetrating aperture 31 is an inclined pressing surface 35 that is inclined relative to the center line of the penetrating aperture 31 (i.e., the shaft axis of the motor shaft 14) such that an inside diameter of the penetrating aperture 31 increases continuously toward the motor shaft 14. An angle of inclination of the inclined pressing surface 35 relative to the center line of the penetrating aperture 31 is identical to an angle of inclination of the inclined bearing surface 25 relative to the shaft axis of the coupling shaft 16. A width dimension of the inclined pressing surface 35 (a dimension of the inclined pressing surface 35 that is parallel to a direction of inclination of the inclined pressing surface 35) is greater than the width dimension of the inclined bearing surface 25.

As shown in FIG. 2, the inside diameter of the penetrating aperture 31 is at a maximum at a position on an end portion of the inclined pressing surface 35 that is on a side that is closer to the motor shaft 14, and at a minimum at a position on an end portion of the mounting plate 32 that is away from the motor shaft 14. The outside diameter of the boss portion 21 is at a maximum at a position on an end portion of the inclined bearing surface 25 that is closer to the motor shaft 14, and is at a minimum at a position on an end portion of the inclined bearing surface 25 that is away from the motor shaft 14. A minimum inside diameter of the penetrating aperture 31 is less than a minimum outside diameter of the boss portion 21, and a maximum inside diameter of the penetrating aperture 31 is greater than a maximum outside diameter of the boss portion 21.

The supporting apparatus 33 has: a plurality of (in this example, four) studs (screw-threaded rods) 36 that are respectively mounted to the motor main body 13; and a plurality of nuts 37 that are screwed onto the respective studs 36 to hold the mounting plate 32 on the respective studs 36.

The respective studs 36 are mounted onto the motor main body 13 by being screwed into a plurality of (in this example, four) screw-threaded apertures 38 that are disposed on the motor main body 13. The respective studs 36 are disposed so as to be parallel to the shaft axis of the motor shaft 14. In addition, the respective studs 36 are disposed at a uniform pitch circumferentially around the shaft axis of the motor shaft 14.

A plurality of (in this example, four) stud passage apertures 39 through which the studs 36 are respectively passed are disposed on the mounting plate 32. In this example, the stud passage apertures 39 are disposed at the four corners of the mounting plate 32. An inside diameter of each of the stud passage apertures 39 is greater than an outside diameter of the studs 36. Consequently, the studs 36 are passed through the stud passage apertures 39 loosely. The mounting plate 32 is held by the respective studs 36 so as to be held between first and second nuts 37 that are screwed onto each of the studs 36. Consequently, a position of the mounting plate 32 relative to the motor shaft 14 in an axial direction of the motor shaft 14 is adjustable by adjusting an amount of thread engagement of each of the nuts 37 on each of the studs 36.

A first end portion of each of the leaf springs 34 is connected to the mounting plate 32 by a screw 40, and a second end portion of each of the leaf springs 34 is connected to the fixed portion 28 by a screw 41. The fixed portion 28 is thereby held elastically by the leaf springs 34. Moreover, a plurality of screw-threaded apertures 42 (FIG. 4) into which the screws 40 are screwed are disposed on the mounting plate 32, and a plurality of screw-threaded apertures (not shown) into which the screws 41 are screwed are disposed on the fixed portion 28.

Next, an operational procedure for manufacturing a hoisting machine with an encoder by mounting the encoder 17 to an existing hoisting machine that includes the motor main body 13 and the motor shaft 14 will be explained. When an encoder 17 is mounted to an existing hoisting machine, the coupling shaft 16 is first fastened loosely to the end surface of the motor shaft 14 by the bolts 19 such that the rotation detector mounting shaft portion 22 is oriented away from the motor shaft 14. In other words, the coupling shaft 16 is fastened to the motor shaft 14 temporarily. Thus, the coupling shaft 16 is mounted onto the end portion of the motor shaft 14 in a state in which displacement of the coupling shaft 16 in a direction that is perpendicular to the shaft axis of the motor shaft 14 is permitted (a shaft temporary fastening step).

Next, each of the studs 36 is mounted to the motor main body 13. The rotation detector mounting shaft portion 22 is subsequently passed through the penetrating aperture 31 by moving the mounting plate 32 closer to the coupling shaft 16 from a side that is further away from the motor shaft 14 than the coupling shaft 16. Next, each of the studs 36 is passed through each of the stud passage apertures 38 while displacing the mounting plate 32 toward the motor shaft 14 to dispose the mounting plate 32 in a state in which the rotation detector mounting shaft portion 22 is passed through the penetrating aperture 31. At this point, the mounting plate 32 is positioned so as to be separated from the coupling shaft 16 (a mounting member disposing step).

Next, the motor shaft 14 and the coupling shaft 16 are rotated by driving the motor 15. At this point, if the shaft axis of the coupling shaft 16 is not aligned with the shaft axis of the motor shaft 14, then the motor shaft 14 is rotated around its shaft axis, but the coupling shaft 16 vibrates due to eccentricity while rotating.

Figure 6:
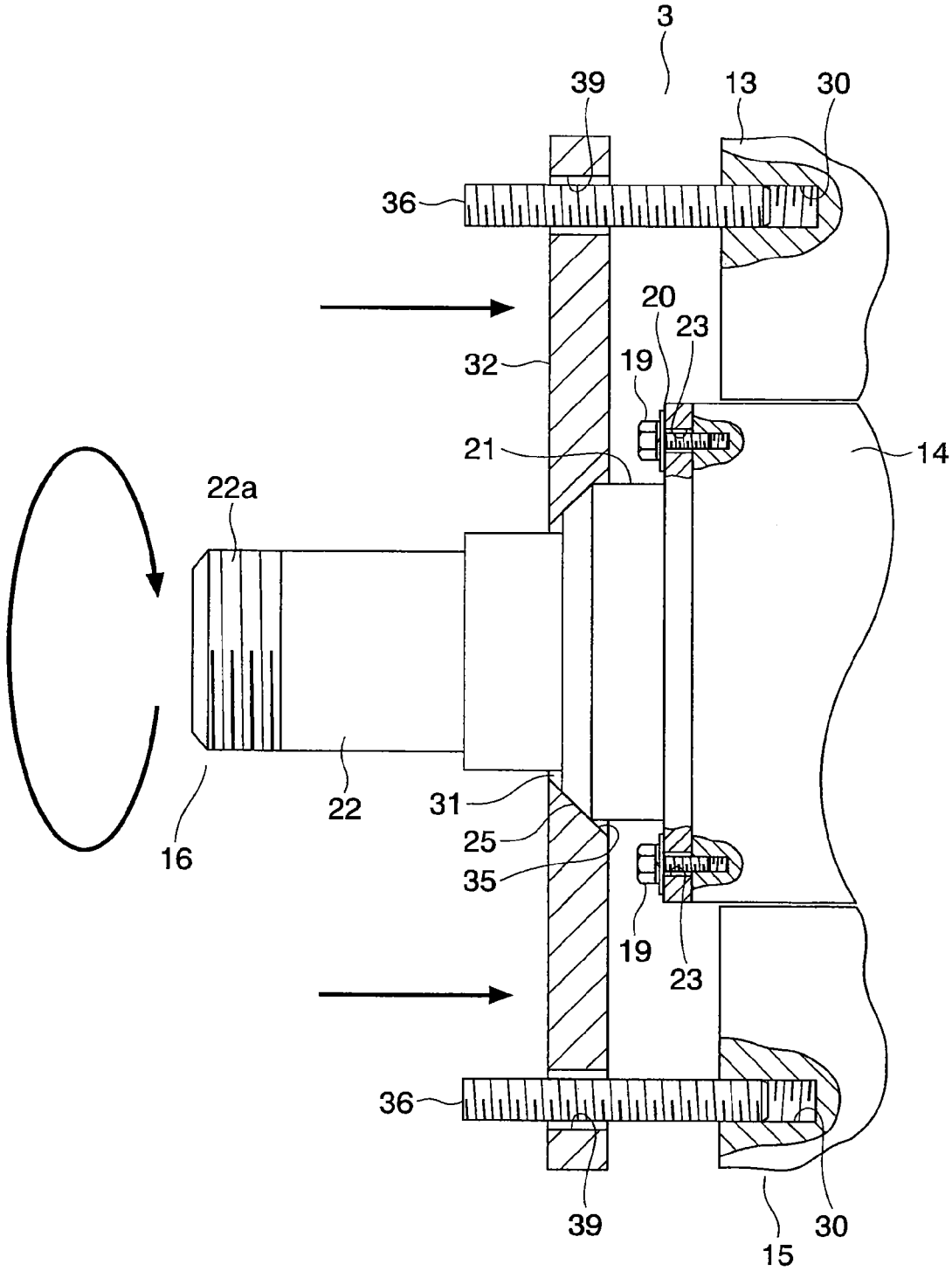
FIG. 6 is a partial cross section that shows a state in which an inclined pressing surface of the mounting plate from FIG. 2 contacts an inclined bearing surface of a boss portion.

Now, FIG. 6 is a partial cross section that shows a state in which the inclined pressing surface 35 of the mounting plate 32 from FIG. 2 contacts the inclined bearing surface 25 of the boss portion 21. Next, as the motor shaft 14 and the coupling shaft 16 are being rotated, the mounting plate 32 is pressed toward the motor shaft 14 while keeping the inclined pressing surface 35 in contact with the inclined bearing surface 25. At this point, the position of the coupling shaft 16 relative to a direction that is perpendicular to the shaft axis of the motor shaft 14 is adjusted while moving the mounting plate 32 in a direction in which vibration of the coupling shaft 16 is reduced. Thus, a position of the coupling shaft 16 is adjusted relative to the motor shaft 14 coaxially (a position adjusting step).

Next, rotation of the motor shaft 14 and the coupling shaft 16 is stopped, and then the coupling shaft 16 is fixed to the motor shaft 14 by fastening each of the bolts 19 (a shaft fixing step).

Next, the mounting plate 32 is removed from the studs 36 temporarily by displacing the coupling shaft 16 away from the motor shaft 14. The first nuts 37 are subsequently screwed onto the studs 36, and then the studs 36 are passed through the stud passage apertures 39 again, and the second nuts 37 are screwed onto the studs 36. Next, the position of the mounting plate 32 is adjusted while adjusting the amount of thread engagement of each of the nuts 37 on the studs 36. The mounting plate 32 is subsequently fixed at predetermined positions that are separated from the coupling shaft 16 by tightening the mounting plate 32 between the nuts 37 (the mounting plate fixing step).

Next, the key 29 is fitted into the keyway 26, and then the encoder 17 is mounted onto the rotation detector mounting shaft portion 22. At this point, the bearing nut 30 is screwed onto the screw-threaded portion 22*a* so as to prevent the encoder 17 from dislodging from the coupling shaft 16. The leaf springs 34 are connected between the mounting plate 32 and the fixed portion 28 such that the fixed portion 28 of the encoder 17 does not rotate (a rotation detector mounting step). The hoisting machine 5 with encoder is completed thereby.

In an elevator hoisting machine 5 of this kind, because the penetrating aperture 31 that has as an inner circumferential surface the inclined pressing surface 35 that is inclined relative to the shaft axis of the motor shaft 14 is disposed on the mounting plate 32, and the annular inclined bearing surface 25 that is inclined relative to the shaft axis of the coupling shaft 16 is disposed on the boss portion 21 of the coupling shaft 16, and the inclined pressing surface 35 is able to contact the inclined bearing surface 25 by the mounting plate 32 being displaced toward the motor shaft 14, the position of the coupling shaft 16 that is mounted to the end portion of the motor shaft 14 can be adjusted to a position that is coaxial to the motor shaft 14 by rotating the motor shaft 14 and the coupling shaft 16 while keeping the inclined pressing surface 35 in contact with the inclined bearing surface 25. Consequently, an adjusting operation (a centering operation) to align the shaft axis of the coupling shaft 16 to the shaft axis of the motor shaft 14 can be performed easily. Because it is no longer necessary to make a construction in which the end portion of the motor shaft 14 fits into an interfitting aperture on the coupling shaft 16, the coupling shaft 16 can be mounted to the end portion of the motor shaft 14 even if the protruding portion of the motor shaft 14 is extremely short. Thus, manufacturing of the hoisting machine 5 can be performed more reliably and easily.

Because the mounting plate 32 is fixed by the supporting apparatus 33 in a state in which the rotation detector mounting shaft portion 22 is passed through the penetrating aperture 31, and the leaf springs 34 that prevent rotation of the fixed portion 28 of the encoder 17 are disposed on the mounting plate 32, the mounting plate 32 can be used not only for the centering operation, but also for mounting of the leaf springs 34 that prevent the rotation of the fixed portion 28. Consequently, reductions in the number of parts can be achieved.

Because the width dimension of the inclined pressing surface 35 is greater than the width dimension of the inclined bearing surface 25, the inclined pressing surface 35 can be kept in contact with the inclined bearing surface 25 more easily, enabling the centering operation to be performed easily.

In a method for manufacturing an elevator hoisting machine 5 of this kind, because the coupling shaft 16 is fastened temporarily to the end portion of the motor shaft 14, and then the position of the coupling shaft 16 is adjusted so as to be coaxial to the motor shaft 14 by pressing the mounting plate 32 while keeping the inclined pressing surface 35 in contact with the inclined bearing surface 25 as the motor shaft 14 and the coupling shaft 16 are rotated, the centering operation can be performed easily. Because the position of the coupling shaft 16 is adjusted in a state in which the coupling shaft 16 is fastened temporarily to the motor shaft 14, it is no longer necessary to make a construction in which the end portion of the motor shaft 14 fits into an interfitting aperture on the coupling shaft 16, enabling the coupling shaft 16 to be mounted to the end portion of the motor shaft 14 even if the protruding portion of the motor shaft 14 is extremely short. Thus, manufacturing of the hoisting machine 5 can be performed more reliably and easily.

Moreover, in the above example, surface treatments have not been performed on the inclined bearing surface 25 or the inclined pressing surface 35, but a treatment that facilitates sliding (a treatment that reduces the coefficient of friction) may also be performed on the inclined bearing surface 25 and the inclined pressing surface 35. For example, a treatment that forms a coating of Teflon (registered trademark) (polytetrafluoroethylene) or a treatment that applies a lubricant, etc., may also be performed on the inclined bearing surface 25 and the inclined pressing surface 35. The inclined pressing surface 35 and the inclined bearing surface 25 that contact each other can thereby be made to slide easily, enabling the centering operation to be further facilitated.

In the above example, the mounting plate 32 that is used in the centering operation is also used to mount the leaf springs 34, but the mounting plate 32 may also be used only for the centering operation, and a member for mounting the leaf springs 34 may be a member that is separate from the mounting plate 32 (a dedicated member for mounting the leaf springs 34).

In the above example, the width dimension of the inclined pressing surface 35 is greater than the width dimension of the inclined bearing surface 25, but provided that the inclined pressing surface 35 can contact the inclined bearing surface 25 by displacement of the mounting plate 32 toward the motor shaft 14, the width dimension of the inclined pressing surface 35 may also be smaller than the width dimension of the inclined bearing surface 25, or the respective width dimensions of the inclined pressing surface 35 and the inclined bearing surface 25 may also be identical.

The invention claimed is:

1. An elevator hoisting machine comprising:

a motor comprising:

a motor main body; and a motor shaft that is rotated by the motor main body;

a coupling shaft comprising:

a boss portion; and a rotation detector mounting shaft portion that protrudes outward from the boss portion away from the motor shaft, the coupling shaft being mountable to and removable from an end portion of the motor shaft;

a mounting member on which is disposed a penetrating aperture through which the rotation detector mounting shaft portion is passed; and a rotation detector that is mounted to the rotation detector mounting shaft portion, wherein:

an inner circumferential surface of the penetrating aperture is an inclined pressing surface that is inclined relative to a shaft axis of the motor shaft such that an inside diameter of the penetrating aperture increases continuously toward the motor shaft;

an inclined bearing surface that is inclined relative to a shaft axis of the coupling shaft is disposed on the boss portion so as to be formed into an annular shape around the shaft axis of the coupling shaft, and such that an outside diameter of the boss portion increases continuously toward the motor shaft; and the inclined pressing surface is able to contact the inclined bearing surface by the mounting member being displaced toward the motor shaft.

2. An elevator hoisting machine according to claim 1, further comprising a supporting apparatus that fixes a position of the mounting member relative to the motor main body in a state in which the rotation detector mounting shaft portion is passed through the penetrating aperture, the rotation detector comprises:

a rotating portion that is rotated together with the rotation detector mounting shaft portion; and an annular fixed portion that surrounds the rotating portion, and a connecting member that prevents rotation of the fixed portion is disposed on the mounting member.

3. An elevator hoisting machine according to claim 1, wherein a width dimension of the inclined pressing surface is greater than a width dimension of the inclined bearing surface.

4. An elevator hoisting machine according to claim 1, wherein a treatment that reduces a coefficient of friction is performed on the inclined pressing surface and the inclined bearing surface.

5. An elevator hoisting machine manufacturing method comprising:

a shaft temporary fastening step in which a coupling shaft that has:

a boss portion; and a rotation detector mounting shaft portion that protrudes outward from the boss portion away from a motor shaft, is mounted to an end portion of the motor shaft such that displacement of the coupling shaft is permitted in a direction that is perpendicular to a shaft axis of the motor shaft;

a mounting member disposing step in which a mounting member on which is disposed a penetrating aperture that has a center line and that has an inner circumferential surface that is an inclined pressing surface that is inclined relative to the center line is disposed in a state in which the rotation detector mounting shaft portion passes through the penetrating aperture;

a position adjusting step in which a position of the coupling shaft is adjusted so as to be coaxial to the motor shaft by pressing the mounting member toward the motor shaft while keeping the inclined pressing surface in contact with an annular inclined bearing surface that is disposed on the boss portion as the motor shaft and the coupling shaft are rotated;

a shaft fixing step in which the coupling shaft is fixed to the motor shaft after the position adjusting step; and a rotation detector mounting step in which a rotation detector is mounted to the rotation detector mounting shaft portion after the shaft fixing step.

6. An elevator hoisting machine according to claim 2, wherein a width dimension of the inclined pressing surface is greater than a width dimension of the inclined bearing surface.

7. An elevator hoisting machine according to claim 2, wherein a treatment that reduces a coefficient of friction is performed on the inclined pressing surface and the inclined bearing surface.

8. An elevator hoisting machine according to claim 3, wherein a treatment that reduces a coefficient of friction is performed on the inclined pressing surface and the inclined bearing surface.

9. An elevator hoisting machine according to claim 6, wherein a treatment that reduces a coefficient of friction is performed on the inclined pressing surface and the inclined bearing surface.

* * * * *